US005915648A

United States Patent [19]

Madrzak et al.

[11] Patent Number: 5,915,648

[45] Date of Patent: Jun. 29, 1999

[54] PERFORATED ROLL FOR GUIDING A FLEXIBLE MATERIAL WEB

[75] Inventors: Zygmunt Madrzak; Karl Rück, both of Heidenheim, Germany

[73] Assignee: Voith Sulzer Papiermaschinen GmbH, Germany

[21] Appl. No.: 08/975,388

[22] Filed: Nov. 20, 1997

[30] Foreign Application Priority Data

Nov. 20, 1996 [DE] Germany ..... 196 47 919

[51] Int. Cl.[6] ..... B65H 27/00; B65H 20/12

[52] U.S. Cl. ..... 242/615.2; 226/95; 162/368; 492/12; 492/20

[58] Field of Search ..... 242/615.2, 542.4, 242/581, 908; 226/95; 492/12, 20; 162/368, 369, 370, 371, 372

[56] References Cited

U.S. PATENT DOCUMENTS

| | | | |
|---|---|---|---|
| 1,661,646 | 3/1928 | Wilhelm | 492/12 |
| 2,714,840 | 8/1955 | Bayrer et al. | 226/95 |
| 3,549,098 | 12/1970 | Helkala | 242/542.4 |
| 3,915,407 | 10/1975 | Zaydowicz et al. | 242/581 |
| 4,611,638 | 9/1986 | Matumura | 242/581 |
| 5,456,802 | 10/1995 | Worcester | 226/95 |

FOREIGN PATENT DOCUMENTS

| | | |
|---|---|---|
| 644472 | 5/1937 | Germany . |
| 9106451 | 5/1991 | Germany . |

OTHER PUBLICATIONS

JP 2–8139 a., In Patents Abstracts of Japan, M–950, Mar. 16, 1990, vol. 14, No. 140.

*Primary Examiner*—John M. Jillions
*Attorney, Agent, or Firm*—Ostrolenk, Faber, Gerb & Soffen, LLP

[57] ABSTRACT

A drum for guiding a material web, in particular a paper web. The drum has a jacket and a hollow interior. A respective cover at each end of the jacket. A respective bearing journal at each cover for supporting the roll to rotate. The jacket has a plurality of passage openings for passage of air therethrough. At least one and perhaps two impellers inside the interior of the drum, each having a suction side for drawing air into the drum through the passage openings. A pressure side at the other side of the impeller. Air exits the drum from the pressure side of the impeller through passage openings and/or an opening in a cover.

21 Claims, 4 Drawing Sheets

PERFORATED ROLL FOR GUIDING A FLEXIBLE MATERIAL WEB

BACKGROUND OF THE INVENTION

The invention relates to a roll for guiding a material web in a machine, in particular a paper or board web within a papermaking or coating machine, comprising a roll or drum comprising a jacket and two end covers provided with bearing journals, and the jacket has a number of passage openings through it.

Known web guide devices comprise a drilled or perforated roll or a drum which guides a web. During start-up of the machine or in the event of a break in the material web, a narrow material web strip, also called a threading strip is guided over the roll. During normal operation of the machine, the entire material web is guided over the roll. The roll is connected to a suction device which applies a negative pressure to the interior of the roll. The connection is via a drilled hole in the bearing journal of the roll end cover. The negative pressure in the roll is transferred through the outer surface of the roll jacket through the openings which penetrate the roll jacket. This avoids fluttering or disturbed running of the material web.

Known rolls have disadvantages including eddy losses in the air flow in the interior of the roll and friction losses in the bearing journal drilled hole. As machine speeds rise, the disadvantages become so large that it is no longer possible to apply adequate vacuum in the interior of the roll. To remedy this, the cross section of the drilled hole arranged in the bearing journal must be enlarged. However, enlargement is not arbitrarily possible. As a result, the known roll cannot be used at high machine speeds.

Furthermore, in some known rolls having air passage openings in the jacket, suction is applied by a suction box at the outer surface of the jacket. This introduces negative pressure into the interior of the roll. The negative pressure is propagated via the air passage openings in the jacket over the region of the roll that is covered by the material web. Because of the high space requirement of devices with such suction boxes and because space is not available in every machine, possible uses of the devices are restricted.

SUMMARY OF THE INVENTION

It is therefore the object of the invention to provide a simply and compactly constructed roll which ensures quiet and flutter-free guidance of a web, even at high machine speeds.

The invention comprises a drilled drum, also called a carrier drum, which has a circumferential jacket and is hollow within the jacket. End covers close the jacket at its axial ends. A respective bearing journal supports the roll at each end. The jacket has a number of passage openings, through which a negative pressure can be applied or transferred from the interior of the drum onto the outer surface of the drum jacket.

At least one air impeller inside the drum moves air through the interior of the drum to produce a negative pressure and/or a positive pressure in the drum which communicates to the exterior of the jacket through the passage openings. Producing a negative or a positive pressure directly in the interior of the drum shortens the paths of the air flow in an advantageous manner and acts independent of eddy losses. As a result, the flow losses that occur when suction is applied to the drum, e.g., through a suction passage in the roll journal, can be reduced. This improves the energy efficiency of the device for guiding a material web. The device is of very compact construction. As a result, the space requirements of the machine for the device can be reduced.

In a particularly preferred embodiment, the impeller is connected in a rotationally fixed manner to a drive shaft that is concentric with the rotation axis of the drum. The impeller can divide the interior of the drum into separated chambers along the longitudinal direction such that the drum has suction applied only over a part of its length, that is, the interior and the outer surface have negative pressure applied to them only on some axial regions. The outer dimensions of the impeller are preferably matched to the interior of the drum such that undesirable back flow of the air conveyed by the impeller, from the pressure side to the suction side of the impeller, is prevented or at least kept very small. In this embodiment, the drum interior is divided into two separated chambers. This permits a further improvement in the efficiency of the suction, which reduces the operating costs of the machine.

In a preferred embodiment, the impeller may be driven from the outside by a drive shaft. For example, a gear wheel arranged on the shaft is connected to a drive device or a belt pulley connected to a belt drive, which applies a driving torque to the drive shaft.

In another embodiment, the impeller can be driven by an electric motor disposed in the interior of the drum. This further reduces the space needed for the device. Direct arrangement of the electric motor in the region of the impeller shortens the drive train, so that the cost for the device for guiding a material web can be reduced.

A further preferred embodiment has the impeller arranged in the end edge region of the drum. The suction side of the impeller faces the directly adjacent edge region. Applying suction to the edge region acts upon a narrow material web strip, a so-called threading strip, which is led through the machine during the start up of the machine or following a web break, and the threading strip can be securely fixed to and guided over the drum.

Other features and advantages of the present invention will become apparent from the following description of the invention which refers to the accompanying drawings.

DESCRIPTION OF PREFERRED EMBODIMENTS

The device and particularly a roll of the invention may be used generally within a machine for guiding a material web. The following text assumes as an example that the device is arranged within a machine for producing a paper web, that is a paper machine, and that the device guides a paper web.

Figure 1:
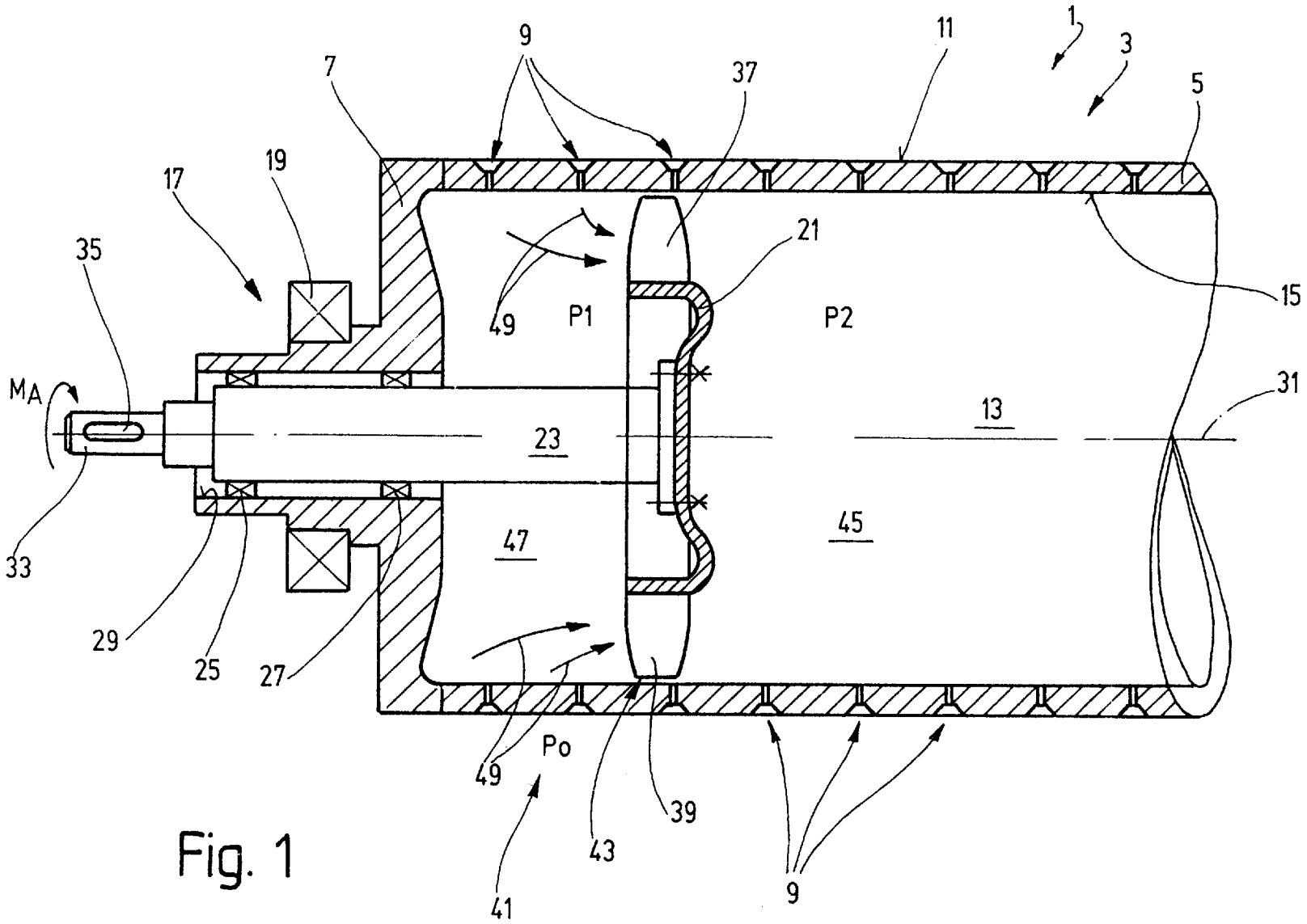
FIGS. 1–4 each show a side, cross-sectional view of a respective embodiment of a device according to the invention.

The device 1 in FIG. 1 comprises a drum or roll 3, which has a circumferential jacket 5 which is hollow inside. The jacket is closed at both opposite axial end regions by a cover. Only end cover 7 is seen in FIG. 1. The jacket 5 has a plurality of passage openings 9 through it, which connect the outer surface 11 of the jacket 5 to the hollow interior 13. The passage openings 9 may be drilled holes. They have an expanded cross section in the region of the outer surface 11 of the jacket. The interior 13 of the roll 3 defines a circular cylindrical passage opening 15.

The cover 7 at the end of the roll 3 seals the interior against the environment. The cover 7 is fastened to the jacket 5 using fastening means, not illustrated. In this embodiment, the cover 7 is formed in one piece with a bearing journal 17 for the roll, on which a bearing 19 is arranged. A second cover at the other end of the roll 3 has a further bearing journal on it. The bearing journals support the roll 3.

An impeller 21 inside the roll 3 is rotationally fixed to a drive shaft 23. The drive shaft 23 is supported by bearings 25 and 27 in a drilled hole 29 that penetrates the cover 7 and the bearing journal 17. The hole 29 runs concentrically with the axis of rotation 31 of the roll 3, indicated with dashed lines. The drive shaft 23 is supported at the one side cover 7, in a floating manner, and the shaft has a drive journal 33. A groove 35 in the drive journal 33 accommodates a spring key. Drive torque is transmitted to the drive shaft 23 via the drive journal 33 from a drive device, not illustrated. The drive device may directly engage the drive journal 33 or, for example, be connected to the latter via a gear wheel or a belt pulley.

The impeller 21, which is connected on the drive shaft 23 has blades or vanes, of which blades 37 and 39 are visible. The impeller 21 is arranged toward the end edge region 41 of the roll 3. The outer diameter of the impeller 21 is generally matched to the diameter of the passage opening 15 producing a narrow gap 13 between the ends of the blades of the impeller 21 and the interior of the jacket 5 of the roll 3. The impeller 21 divides the interior 13 of the roll 3 into separate chambers 45 and 47. The first, smaller chamber 47 is bounded by the impeller 21, the cover 7 and the jacket 5. The second, larger chamber 45 is bounded by the impeller 21 and the opposite second cover 8 (not shown in FIG. 1, but seen in other Figures) or a further impeller in the passage 15, not shown, as well as the jacket 5. The impeller is an axial impeller with a suction side which faces the smaller chamber 47, and a pressure side, which faces the chamber 45.

When a drive or turning torque is applied to the impeller 21, it sucks air from the outer surface 11 of the jacket through the passage openings 9 into the chamber 47 toward the edge region 41. That air flow is indicated by arrows 49. The air sucked in is conveyed by the impeller 21 out of the chamber 47 and into the chamber 45, and air can escape through the passage openings 9 in the jacket 5 of the roll 3 in the region of the chamber 47.

When suction is applied to the roll 3, the following pressure relationships are produced. A negative pressure $p_1$ prevails in the chamber 47. That pressure is lower than the negative pressure $p_0$ prevailing at the exterior of the jacket 5 at the edge region 41 to which suction is applied. Starting from atmospheric pressure as a reference variable, and considering absolute pressures, the pressure $p_1$ is therefore lower than the pressure $p_0$. A positive pressure, designated by $P_2$, prevails in the chamber 45.

The negative pressure $p_0$ acting at the edge region 41 on the outer surface 11 of the roll 3, holds a paper web or, in particular, a threading strip, which is a narrow strip, or tail of the paper web and which is guided over the roll 3, by sucking it against and holding it fast to the surface of the jacket 5. The threading strip can be guided quietly and without fluttering over and partially wrap the roll 3. Furthermore, suction applied to the roll 3 reliably prevents lateral movement of the strip in either of the directions toward the center or the lateral edge of the roll.

The device 1 has a compact construction. Friction losses are very low as a result of the short paths of the air flow. The device 1 can be used even at high machine speeds, since a high negative pressure can be ensured at any time. Complicated and high-cost pipelines, which are used to bring the air out of the roll in known devices, are not needed here.

Figure 2:
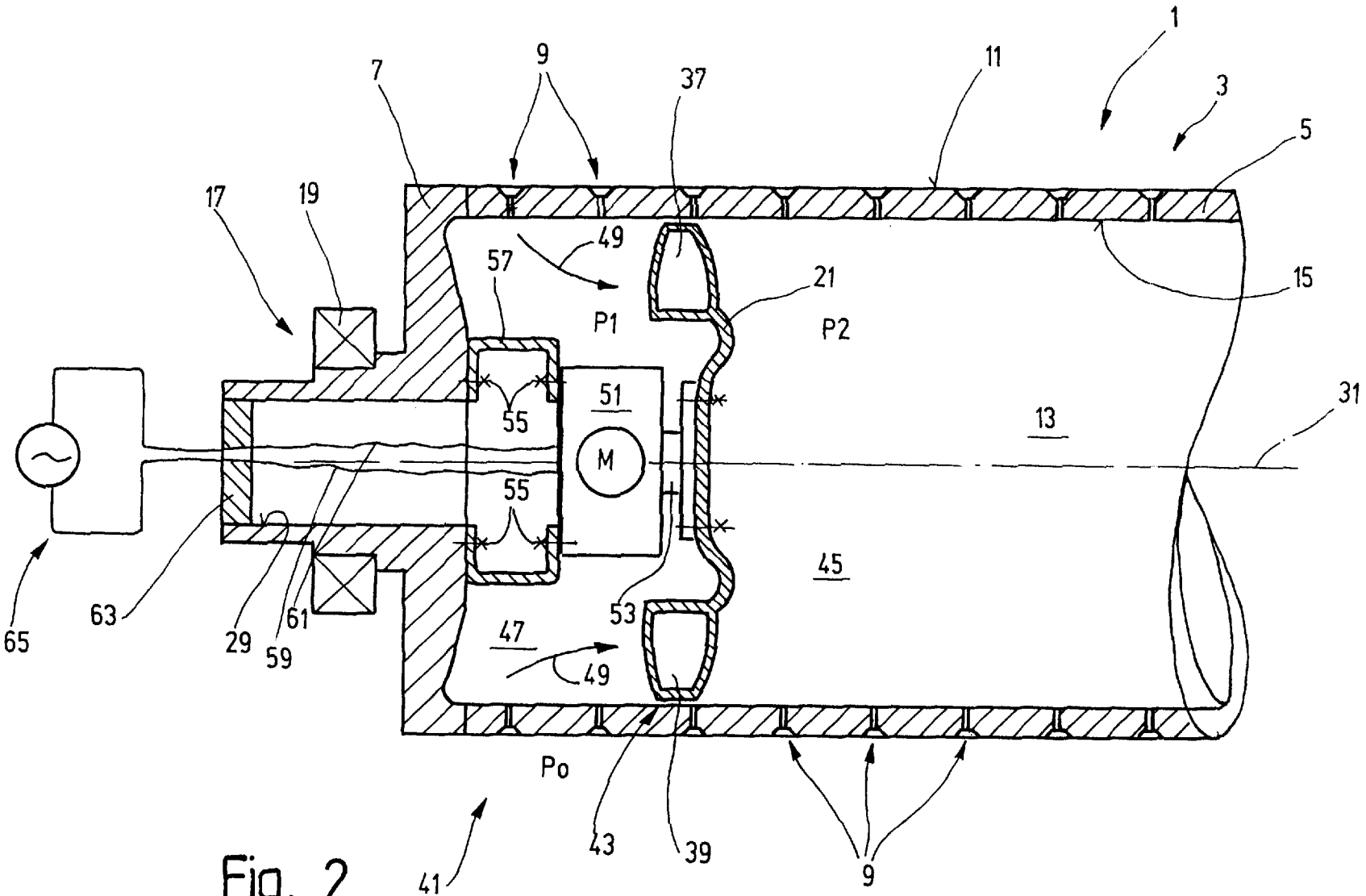

FIG. 2 shows a further embodiment of the device 1. Parts which correspond to those in FIG. 1 have identical reference numbers. Only the differences are discussed.

An electric motor 51 is arranged in the interior of the roll 3. An impeller 21 is connected in a rotationally fixed manner to the motor shaft 53. The electric motor 51 is fastened to a retaining flange 57 using fastening means 55 that are schematically indicated, for example screws. The retaining flange 57 is fixed to the cover 7 of the roll 3 using further fastening means 55. Energy is supplied to the electric motor 51 via connecting lines 59 and 61, which pass through the drilled hole 29 in the cover 7. The connecting lines 59 and 61 are connected to a contact plate 63 or end at that plate, and that plate seals off the drilled hole 29 and thus the interior 13 of the drum with respect to the environment. A power supply device 65 is connected to the connecting lines 59 and 61 by sliding contacts, not illustrated, that rest on the contact plate.

When the device 1 is put into operation, or during its continuous operation, the impeller 21 inside the rotating roll 3 can be driven by the electric motor. This impeller 21 sucks air via the passage openings 9 from the outer surface 11 of the roll 3, through the passage openings 9 at chamber 47, into the interior 13 in the chamber 47. That air flow is indicated by arrows 49. Air in the chamber 47 is conveyed by the impeller 21 into the second chamber 45. Air can escape from the chamber 45 to the outer surface of the jacket or to the environment through the passage openings 9 in the jacket of the roll 3 that are arranged over the axial region of the chamber 45. The impeller 21 sucks air in the edge region 41 at the outer surface 11 of the roll 3 producing a negative pressure $p_0$ at the surface. The pressure relationships within the chambers 45 and 47 and, respectively, the interior 13, correspond to the pressures described for FIG. 1. The negative pressure $P_1$ acting in the chamber 47 is greater than the negative pressure $p_0$, and a positive pressure $P_2$, which can escape through the passage openings 9, acts in the chamber 45. Comparing the two pressures $p_1$ and $p_0$, both considered as absolute variables, the pressure $p_1$ in the chamber 47 is lower than the ambient pressure or atmospheric pressure, and is lower than the pressure $p_0$ outside the jacket at that chamber.

The embodiment of the device 1 in FIG. 2 is distinguished by a compact construction, because the impeller drive is positioned in the roll. The device can be used within a machine even in particularly constricted installation conditions.

Figure 3:
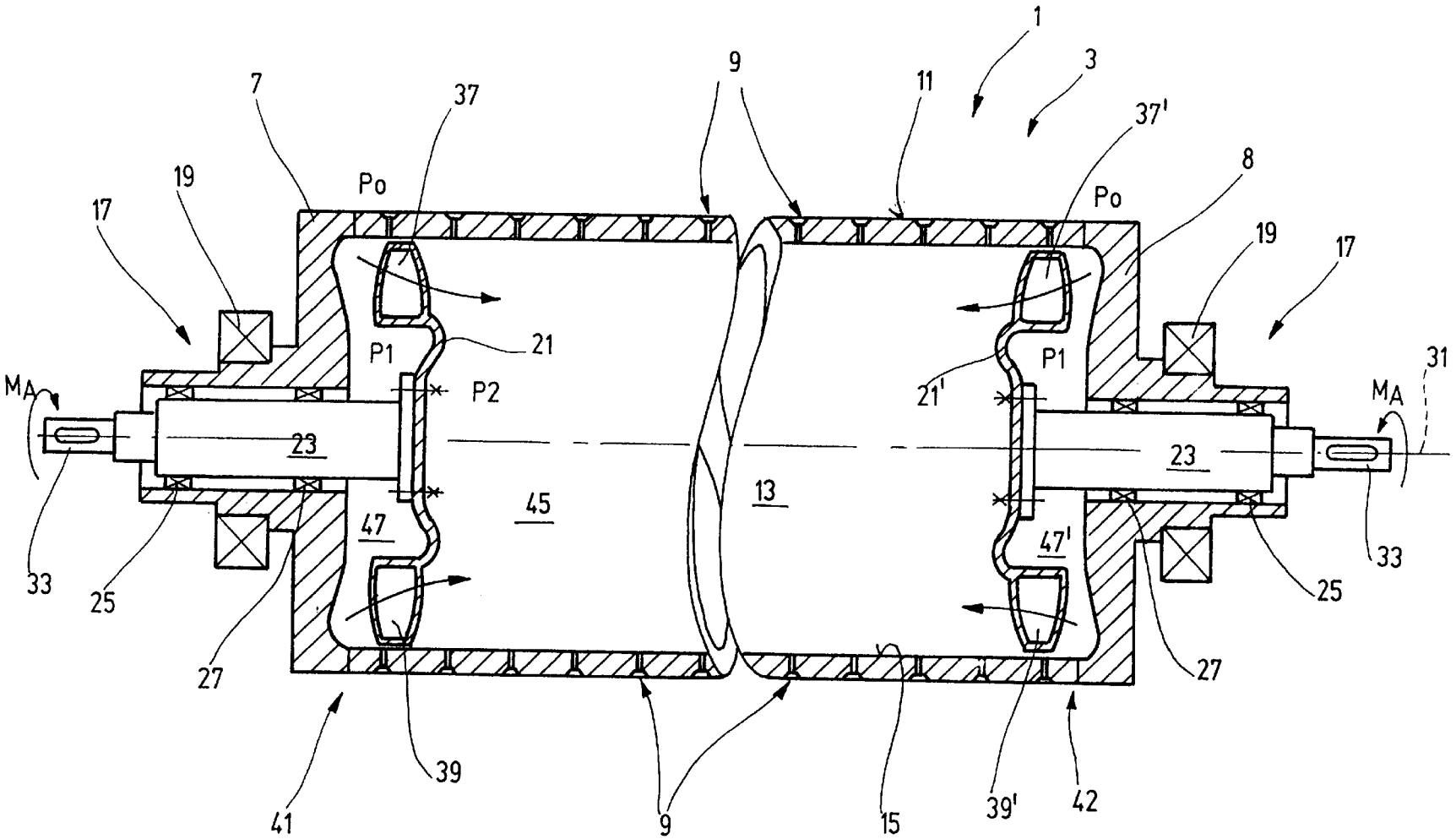

FIG. 3 shows a third embodiment. Identical parts are again provided with identical reference numbers. FIG. 3 differs from FIG. 1 in that both a first impeller 21 and a second impeller 21' are arranged in the interior of the roll 3 in the two end edge regions 41 and 42 of the roll 3. The impeller 21' at the right in the region 42 is connected in a rotationally fixed manner to a drive shaft 23, similarly to the impeller 21 described in FIG. 1. That drive shaft 23 is supported in a floating manner in the drum cover 8 by bearings 25 and 27. This impeller 21' is arranged concentrically with the axis of rotation 31 of the roll and that impeller divides off a further chamber 47' in the interior 13 between the impeller 21' and the cover 8. The suction side of the impeller 21' faces the cover 8. This makes it possible to apply suction to the outer surface 11 of the roll 3 in the edge region 42 when the impeller 21' is operating. The interior 13 of the entire roll 3 is thus subdivided into three separate chambers, the chambers 47 and 47' arranged in the end regions of the roll, and the chamber 45 between the impellers 21 and 21'.

If a drive torque is applied to both drive shafts 23 of the impellers 21 and 21' (see arrows MA), suction is applied to the edge regions 41 and 42 of the roll. This produces negative pressures $p_0$ at the outer surface of the roll jacket at the edge regions. The negative pressure reliably holds a paper web guided over the roll or respective threading strips on the roll 3 at the edge regions. As a result, the web or strip can be transferred in a flutter-free and quiet manner. The option of applying suction on both sides to the edges expands the possible uses and applications of the device 1.

As described above, the impellers 21 and 21' can be driven separately. They can each have an electric motor which may be arranged in the interior of the roll, or else their drives can be supplied from outside, for example, by means of respective belt drives.

Figure 4:
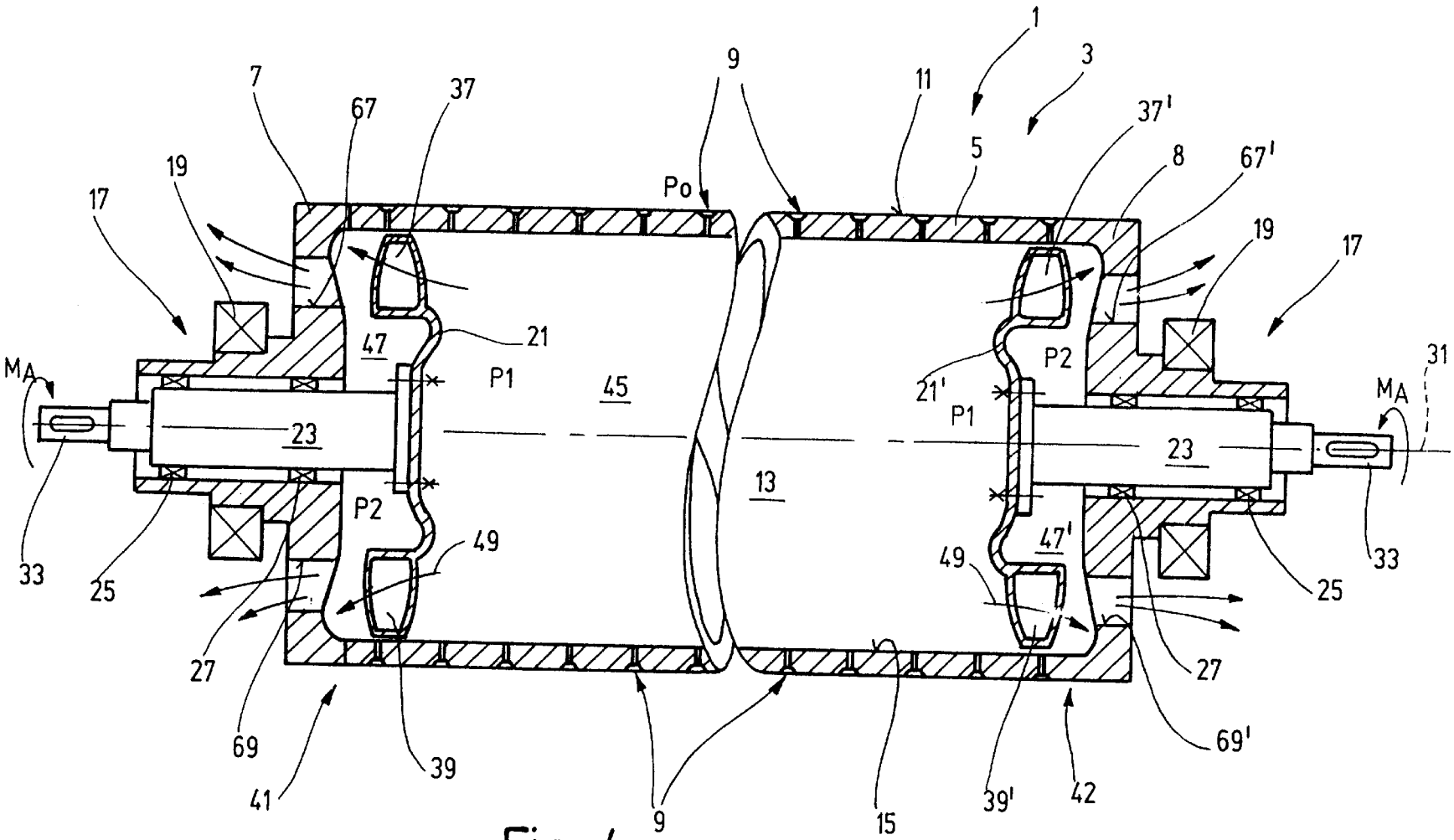

FIG. 4 shows a fourth embodiment of the device 1. Identical parts are again provided with identical reference numbers. A respective impeller 21, 21' in the interior 13 of the roll 3 is close to each edge region 41 and 42. In contrast to FIG. 3, the suction sides of both impellers 21 and 21' face the center of the roll 3. Drilled holes 67 and 69 are provided in the cover 7, while drilled holes 67' and 69' are provided in the cover 8. They enable an additional fluidic connection from the interior of the roll 3 to the outside. Their function is explained below using air flow produced during the operation of the impellers.

When the drive torque, indicated by MA and an arrow, is applied to either or both of the drive shafts 23, the impellers 21 and 21' begin to suck air from the outer surface 11 in the central region of the chamber 45, through the passage openings 9 in the central region in the jacket 5 of the roll 3, and convey the air into the edge chambers 45 and 47', respectively. Positive pressure is developed in the chambers 47 and 47'. The air under positive pressure can escape to the outside through the drilled holes 67 and 69 at one end and 67' and 69' at the other end. In the region of the outer surface 11 of the jacket 5 where suction is applied, a negative pressure $p_0$ is produced which is smaller than the negative pressure $p_1$ acting in the chamber 45.

The arrangement of the impellers at the end regions of the roll as well as the placements of drilled holes in the end covers of the roll makes it possible to apply suction to the entire outer operative web holding surface of the jacket 5 of the roll 3. The device 1 depicted in FIG. 4 can thus be used both for transferring an entire material web and/or a narrow threading strip at an edge of the web.

The impellers 21 and 21' described as to FIGS. 1 to 4 can be either axial flow impellers or transverse flow impellers. Their concentric mounting in relation to the axis of rotation 31 of the roll 3 advantageously divides the roll interior into several chambers. As a result, suction and/or blowing can be applied to a defined region of the outer surface of the roll. The impellers are preferably constructed as fan impellers, that is, the pressure ratio between their pressure side and their suction side is preferably smaller than 1.3. It is also possible to construct the impellers as compressor impellers, enabling a greater pressure ratio and thus a higher negative pressure/positive pressure can be produced.

The device 1 according to the invention can, for example, be used inside a papermaking machine in place of a known carrier drum reel-up. A carrier drum reel-up is arranged at the end of the papermaking machine. It comprises a roll, the so-called carrier drum, against which the shaft or winding mandrel is pressed, and on which the finished paper web is intended to be wound up. The paper web is guided over the carrier drum, through a nip between the carrier drum and the shaft, and then the web is wound up onto the shaft. The threading strip that is transferred by means of a transfer device at the beginning of the winding operation is guided onto the carrier drum, or onto the device 1. The negative pressure that is in this case applied from the interior to the outer surface of the roll holds the web strip on the jacket of the roll. As a result, the strip does not move out over the edge of the roll or run toward the center of the roll. This enables reliable transfer of the threading strip even at high machine speeds.

In summary, the device 1 can be simply and compactly constructed and, on account of its simple design, it is of lower cost than known devices. It is possible to use an embodiment of the device 1, explained in FIG. 4, within the drying section or the press section of the papermaking machine, for example to replace a suction roll serving to transfer a drying fabric and a material web. It becomes clear that the device according to the invention can be used anywhere where a material web, a narrow material web strip or planar goods are deflected by a roll and require guidance.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A device for guiding a flexible material web within a machine, the device comprising a drum comprised of a circumferential jacket and having a hollow interior within the jacket, the jacket having opposite lateral ends and having an exterior;

a respective cover at each lateral end of the drum, the covers being shaped for closing the respective lateral ends of the drum against flow of air, and a bearing journal for the drum at each cover;

a plurality of passage openings through the jacket for permitting the flow of air between the interior and the exterior of the jacket;

at least one impeller in the drum interior for directing air axially along the drum interior, the impeller having a suction side in the interior of the drum and a pressure side in the interior of the drum, and wherein the impeller is adapted for creating negative pressure in the drum on the suction side of the impeller, whereby air may be drawn into the interior of the drum through the passage openings at the region of the drum with negative pressure; the impeller is so positioned along the interior of the drum as to divide the interior of the drum into separated chambers at opposite axial sides of the impeller which are at the suction side and the pressure side.

2. The device of claim 1, wherein the impeller directs air past the impeller.

3. The device of claim 1, wherein the impeller is so placed in the jacket that air may be pumped through the passage openings in the drum at the pressure side of the impeller.

4. The device of claim 3, further comprising an exit opening in the cover at the pressure side of the impeller, such that air at the pressure side of the impeller may be pushed out the exit opening in the cover.

5. The device of claim 3, wherein the passage openings are placed such that air at the pressure side of the impeller may be pushed out the passage openings in the jacket.

6. The device of claim 1, further comprising an exit opening in the cover at the pressure side of the impeller, such that air at the pressure side of the impeller may be pushed out the exit opening in the cover.

7. The device of claim 1, further comprising a drive shaft for the impeller arranged concentric with the axis of the drum, the impeller being connected to the drive shaft to be rotated by the drive shaft.

8. The impeller of claim 7, wherein the drive shaft is driven from outside the drum and communicates to the impeller inside the drum.

9. The device of claim 1, wherein the impeller is so arranged in the interior of the drum as to be closer toward one of the covers and so that the suction side of the impeller faces the cover toward which the impeller is located.

10. The device of claim 1, wherein the impeller is so arranged in the interior of the drum as to be closer toward one of the covers and so that the pressure side of the impeller faces the cover toward which the impeller is located.

11. The device of claim 1, wherein the drum is a rotatable drum and the impeller is rotatable within the drum and with respect to the drum.

12. The device of claim 11, wherein the drum is a rotatable drum adapted for being partially wrapped by a paper web being produced in the papermaking machine.

13. The device of claim 1, wherein the impeller is so positioned that one of the chambers is toward one cover of the drum.

14. The device of claim 1, wherein the impeller is mounted in a floating manner in one of the covers of the drum.

15. The device of claim 1, further comprising a motor in the drum interior and connected with the impeller for driving the impeller to rotate.

16. A The device of claim 1, wherein the impeller is located in the interior of the drum toward one of the lateral ends of the drum.

17. The device of claim 1, further comprising at least two impellers located in the interior of the drum, one near to one lateral end of the drum and the other near to the other lateral end of the drum.

18. The device of claim 17, wherein each impeller has a suction side in the interior of the drum and a pressure side in the interior of the drum, and wherein each impeller is adapted for creating negative pressure in the interior of the drum on the suction side of the impeller; and the respective suction sides of both impellers face outward toward the respective lateral ends of the drum toward which each impeller is near.

19. The device of claim 17, wherein each impeller has a suction side in the interior of the drum and a pressure side in the interior of the drum, and wherein each impeller is adapted for creating negative pressure in the interior of the drum on the suction side of the impeller and the respective suction sides of each impeller faces inward toward the other impeller.

20. The device of claim 1, wherein the impeller comprises an axial impeller.

21. The device of claim 1, wherein the impeller comprises a transverse flow impeller.

* * * * *